US011155054B2

(12) United States Patent
Christophel

(10) Patent No.: US 11,155,054 B2
(45) Date of Patent: Oct. 26, 2021

(54) QUICK ADJUST PRINT SYSTEM FOR POUCH FILLING MACHINES

(71) Applicant: Pouch Pac Innovations, LLC, Sarasota, FL (US)

(72) Inventor: Emmanuel K. Christophel, Port Charlotte, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 124 days.

(21) Appl. No.: 16/567,516

(22) Filed: Sep. 11, 2019

(65) Prior Publication Data

US 2020/0079046 A1 Mar. 12, 2020

Related U.S. Application Data

(60) Provisional application No. 62/729,569, filed on Sep. 11, 2018.

(51) Int. Cl.

| | |
|---|---|
| ***B31B 70/88*** | (2017.01) |
| ***B65B 43/16*** | (2006.01) |
| ***B65B 59/02*** | (2006.01) |
| ***B65B 57/18*** | (2006.01) |
| ***B65B 61/26*** | (2006.01) |
| ***B65B 57/04*** | (2006.01) |
| *B31B 170/00* | (2017.01) |

(52) U.S. Cl.

CPC ..... *B31B 70/88* (2017.08); *B65B 43/16* (2013.01); *B65B 57/04* (2013.01); *B65B 57/18* (2013.01); *B65B 59/02* (2013.01); *B65B 61/26* (2013.01); *B31B 2170/00* (2017.08)

(58) Field of Classification Search

CPC ..... B65B 57/04; B65B 57/18; B65B 61/26; B65B 43/16; B65B 59/02; B65B 59/04; B65B 63/005; B31B 70/88; B31B 2170/00

See application file for complete search history.

(56) References Cited

U.S. PATENT DOCUMENTS

| | | | | |
|---|---|---|---|---|
| 3,190,054 A * | 6/1965 | Arnold | B41F 17/006 | 53/131.4 |
| 4,098,183 A * | 7/1978 | Johnson | B41F 17/22 | 101/40 |
| 4,473,989 A * | 10/1984 | Tsutsumi | B65B 43/30 | 141/166 |
| 5,315,927 A * | 5/1994 | Yeh | B65B 61/26 | 101/35 |
| 6,199,351 B1 * | 3/2001 | Mount | B65B 1/02 | 53/386.1 |
| 6,945,171 B1 * | 9/2005 | Coull | B65B 61/025 | 101/288 |
| 7,401,874 B2 * | 7/2008 | Kunschke | B65C 9/46 | 347/2 |
| 9,308,744 B2 * | 4/2016 | Stevens | B65B 61/26 | |

(Continued)

*Primary Examiner* — Thomas M Wittenschlaeger

(74) *Attorney, Agent, or Firm* — Dinsmore & Shohl LLP

(57) ABSTRACT

A print and inspection apparatus for use with a pouch filling and sealing machine. The apparatus has a platform with a vertical height adjustment. A print module and an inspection module are mounted to carriages which are adjustably movable along a horizontal "X" axis and adjustable along a horizontal "Z" axis. A path for the pouches is formed by a guide rail and back rail. The apparatus permits printing of information on a pouch and inspection of the pouch.

13 Claims, 5 Drawing Sheets

(56) References Cited

U.S. PATENT DOCUMENTS

| | | | | |
|---|---|---|---|---|
| 9,440,759 | B2 * | 9/2016 | Reed | B65C 9/02 |
| 9,864,096 | B2 * | 1/2018 | Fujitomi | G01B 11/24 |
| 10,654,608 | B2 * | 5/2020 | Lizari Illarramendi | A61J 1/00 |
| 10,676,224 | B2 * | 6/2020 | Nakamoto | B65B 43/26 |
| 10,858,134 | B2 * | 12/2020 | Amano | B65H 18/026 |
| 2012/0289391 | A1 * | 11/2012 | Murray | B31B 50/00 493/227 |
| 2014/0360133 | A1 * | 12/2014 | Yoshikane | B65B 43/30 53/386.1 |
| 2015/0284122 | A1 * | 10/2015 | Murray | B65B 43/60 248/99 |
| 2019/0322402 | A1 * | 10/2019 | Matsumura | B65B 57/16 |
| 2020/0002031 | A1 * | 1/2020 | Hiramoto | B65B 3/17 |
| 2020/0223574 | A1 * | 7/2020 | Tong | B65B 59/00 |

* cited by examiner

QUICK ADJUST PRINT SYSTEM FOR POUCH FILLING MACHINES

CROSS-REFERENCE TO RELATED APPLICATIONS

This application claims the benefit of U.S. Provisional Application 62/729,569 filed on Sep. 11, 2018.

FIELD OF THE INVENTION

The invention relates to a device for use with a pouch filling machine, and more particularly for printing on the pouch and inspecting the printing on a turret machine.

BACKGROUND OF THE INVENTION

Rotary or turret machines are used for filling and sealing flexible pouches. The pouches are formed of flexible film. Empty pouches are loaded onto a turret to be suspended by a pair of spaced apart grippers. The turret moves the grippers in a circular path from station to station to be opened, filled and sealed. It is frequently desirable to print information on the pouch at the time of filling. The information, typically, includes date of filling, an expiration date and case lot information. It is known to move the pouches by a conveyor to pass before printers such as inkjet printers. The pouches are printed with information and then loaded on the turret for filling and sealing. The printing process slows the process, the conveyor and utilizes valuable space and requires inspection to make sure the printing is readable. Accordingly, an apparatus for printing and inspecting pouches as part of the filling process would be desirable.

SUMMARY OF THE INVENTION

An apparatus for printing and inspecting a pouch, which is supported on a turret of a fill machine. The apparatus includes a base and a platform mounted to the base. A vertical adjustment mechanism permits adjustment of height of the platform. The apparatus also includes a print module which is movably mounted to the platform and adapted to be positioned along a horizontal axis. The print module has a print head for printing the pouch. The apparatus also includes an inspection module having a camera for inspecting the quality of the print. Inspection module is movably mounted to the platform. The apparatus further includes an adjustable guide mounted to the platform and a back plate spaced apart from the guide to form a path for positioning the pouch for printing. The guide includes elongated members which have a center portion which is curved to conform to the radius of rotation of the pouches and a curve back wall spaced apart from the guide to position the pouch. A further aspect of the invention includes a positioning mechanism which permits an upper module of carriage to move the print head and camera to and away from the pouch.

DETAILED DESCRIPTION OF THE PREFERRED EMBODIMENTS

Figure 1:
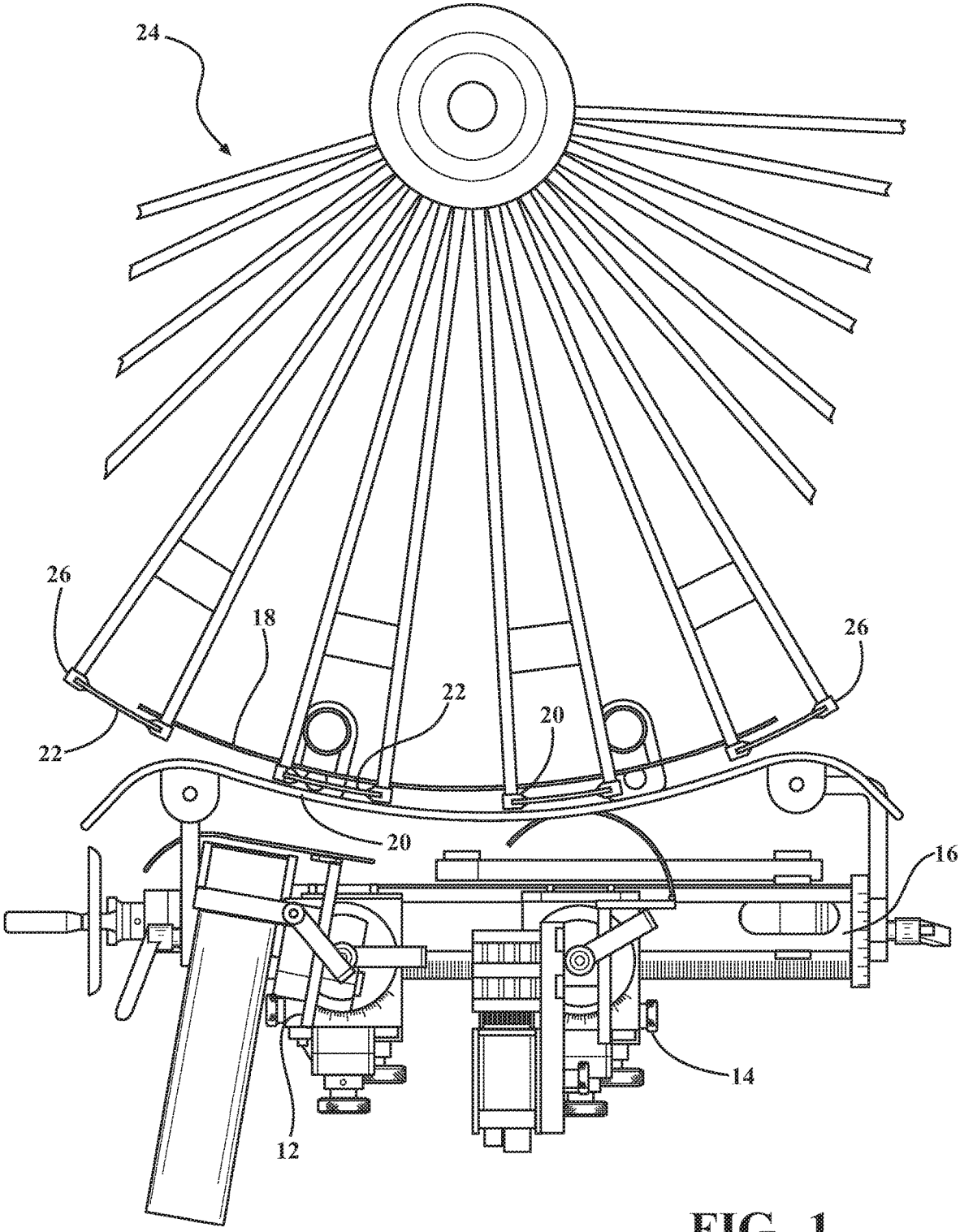
FIG. 1 is a top view of an apparatus for printing and inspecting pouch being filled on a turret of a filling machine.

A print and inspection apparatus 10 for printing and inspecting a flexible pouch 22 while on a turret 24 of a filling and sealing machine is shown in FIGS. 1-4. The filling and sealing machine has a number of stations for opening the pouch, filling the pouch, and sealing the pouch are performed at each station. The pouch is sequentially indexed from station to station. The print and inspection apparatus is mounted at a print station of the turret. The print station is located at the next station after empty pouches are loaded on the turret. The print and inspection apparatus 10 includes a printhead module 12 and camera module 14 which are mounted to a platform 16. The apparatus 12 includes a back plate 18 and a wire guide 20 which are spaced apart to guide and position the pouches 22 as the pouches are moved by the turret 24 of the pouch filling and sealing machine. The apparatus 10 may be mounted to the fill/seal machine or may be a stand alone accessory for the filling and sealing machine. Because the location of the printing is determined by pouch size, the position of the print module and inspection module must be changed. When changing the size pouch being filled, the apparatus 10 has adjustment mechanism which permits ready change and precise positioning of the print module and inspection module.

As shown in FIG. 1, the apparatus 10 is used with a pouch filling and sealing machine having a turret 24 for moving the pouch 22 from station to station during the filling and sealing process. The turret 24 includes grippers 26 at a loading station which suspend the pouches 22. The pouches 22 are loaded onto the grippers 26 and then moved by the turret 24 to a print station 28.

Figure 2:
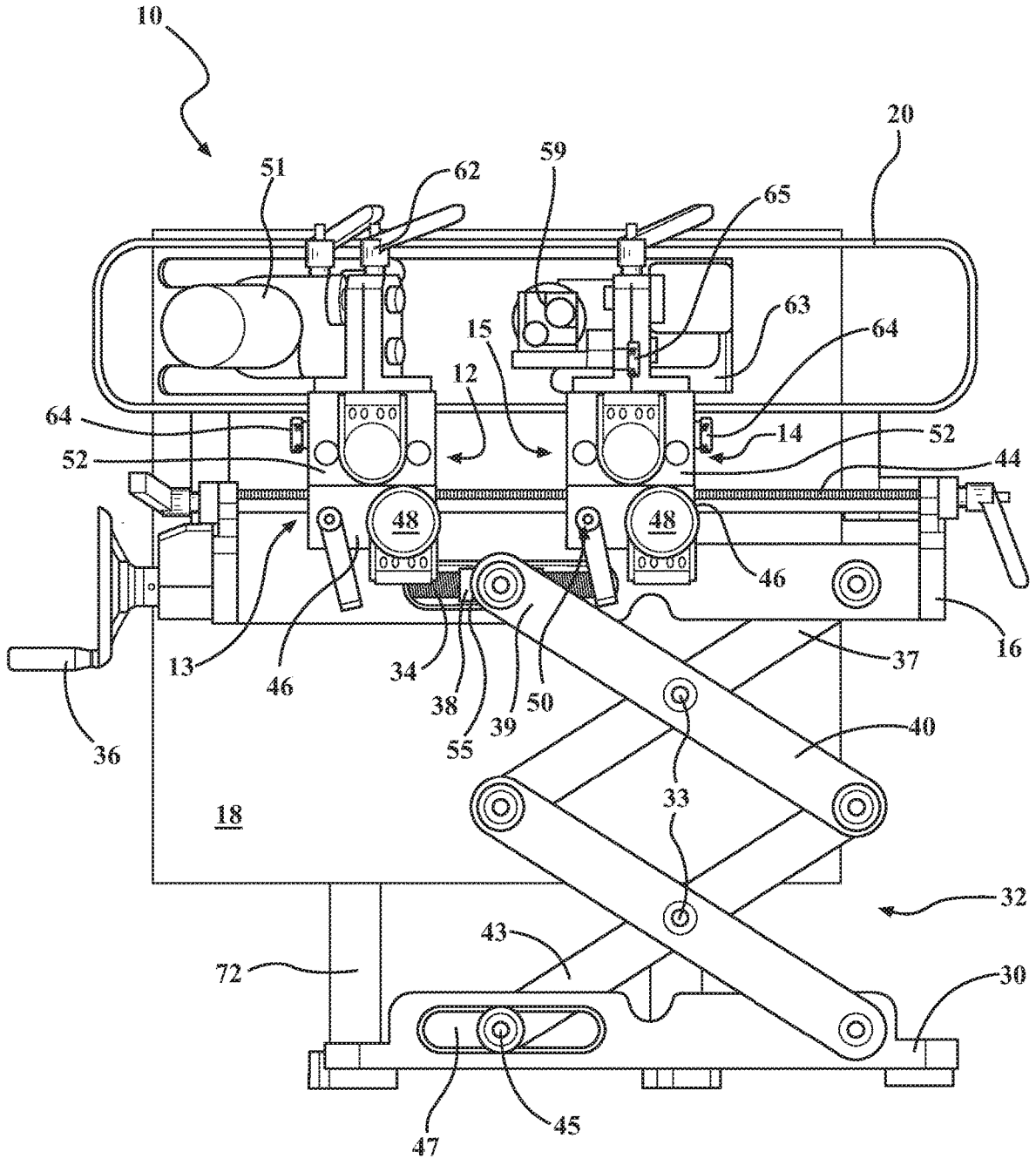
FIG. 2 is a rear view of the apparatus for printing and inspecting.
Figure 3:
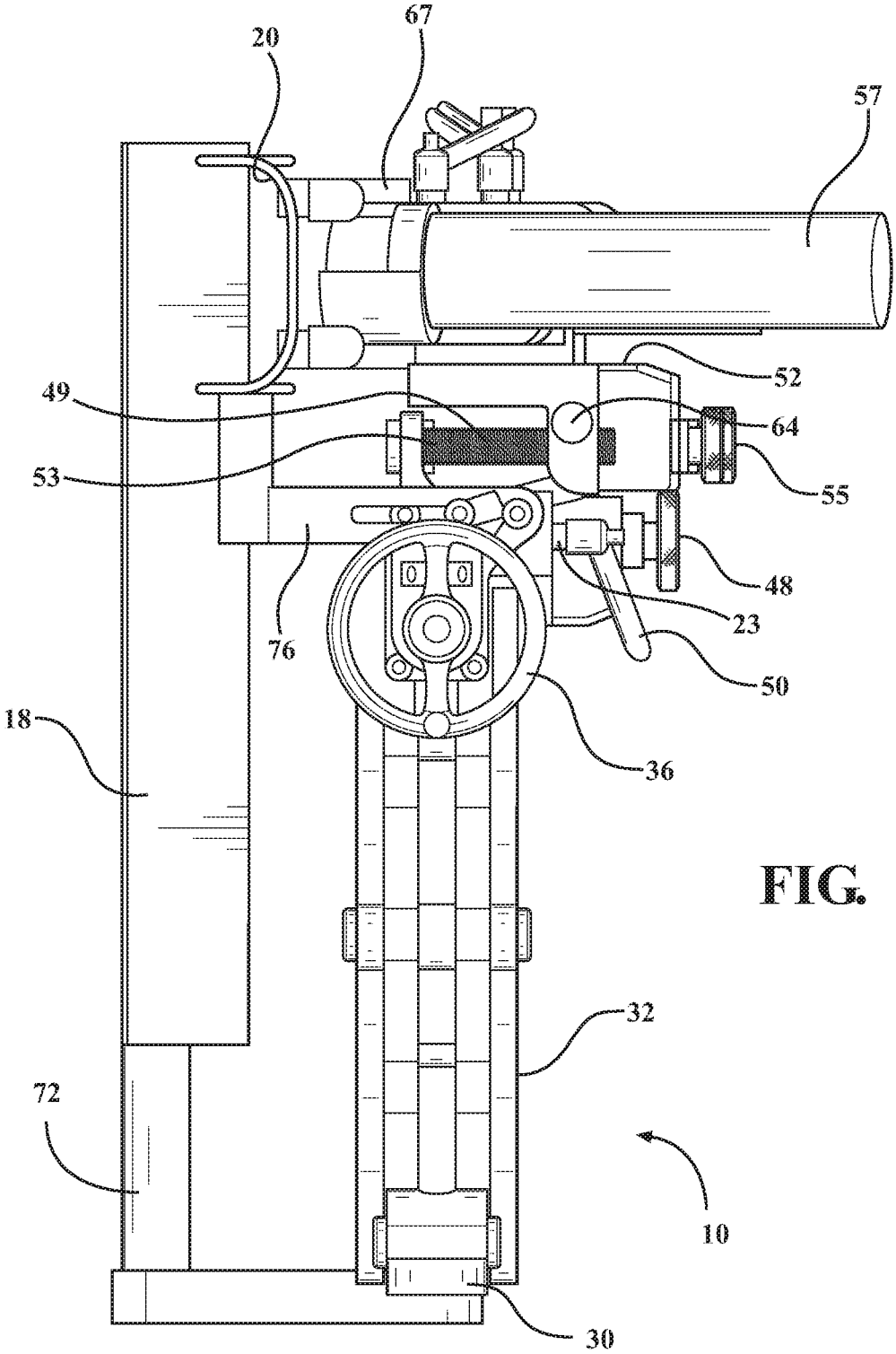
FIG. 3 is a side view of the apparatus for printing and filling.

As shown in FIGS. 2 and 3, the apparatus 10 includes the platform 16 which is supported above a base 30 by a vertical adjustment mechanism. In the preferred embodiment, the adjustment mechanism is a scissor mechanism 32 which is moved to adjust the height of the platform 16. However, the other mechanisms could be used to adjust the height of the platform, such as servo motors, hydraulic rams, and other devices. The centers of pairs of scissor arms 40 are connected by a pivot pin 33. Lower ends of one pair of the scissor arms are connected to the upper ends of the other pair of scissors. A screw rod 34 located within the platform 16 to be rotated by a wheel 36 to move a threaded sleeve 38 along the screw rod 34. The sleeve 38 is mounted to one end 39 of a scissors arm 40 to move the end 39 of the scissors arm 40 horizontally along the screw rod 34. End 43 of one of the lower pair of scissor arms 40 slides on a pin 45 in a slot 47 of the base 30. End 37 of the other arm is pinned to the platform. Rotation of the wheel 36 moves the end 39 of the scissor arm to fold or expand the scissors arms to move the platform 16 up or down in a vertical direction.

As shown in FIGS. 1 and 2, the platform has a rail 42 and a rack 44 which extend longitudinally across the platform 16 from one end to the other end. The print module 14 and inspection module 12 are mounted to slide along the rail 42. Each of the carriages has a lower portion and an upper portion. The print module and inspection each have a carriage 46 which has pinion 23 which engages the rack 44. The pinion 23 is turned by a wheel 48 to move the carriages 13 and 15 on the rail 42. Kipp handles 50 are used to unlock and lock the carriages in place. Each of the carriages has an upper portion 52 which is moved by a screw rod 53 to move towards and away from the wire guide 20. Wheel 55 turns the screw rod 53 to allow ready adjustment of the upper portion 52.

As shown in FIG. 2, the print module 14 includes a print head 59 print head is mounted to an mounted to a wheel 63 to the upper portion 52 of the carriage 46. The print head 59 is mounted so that the print head can be aimed at the pouch 22 between the upper 58 and lower wires 60 of the wire guide 20. Kipp handles 62 are used to lock the print head bracket in position. A dial 61 indicating the degree of rotation is formed on the wheel 63 to allow precise positioning of the print head 59. Spring loaded quick release pins 65 mount the print head so to permit easy release from the carriage for cleaning, maintenance, and the like. The print head 59 may be of any suitable type such as an ink jet printer. The printer has a controller which automatically sets the date and produces lot number. A spring rod 66 extends between the print module 14 and the wire guide 20 to assist in aiming the camera at the pouch.

As noted above, the inspection module 12 has a carriage is the same as the print module carriage with similar positioning and release mechanisms. The inspection module 12 includes a digital camera 37 which permits inspection of the quality of the printing. Additionally, a light assembly (not shown) may be provided to allow provide contrast with the print and different color pouch backgrounds. A RGB light is used to increase a contrast between the print and the background.

Figure 5:
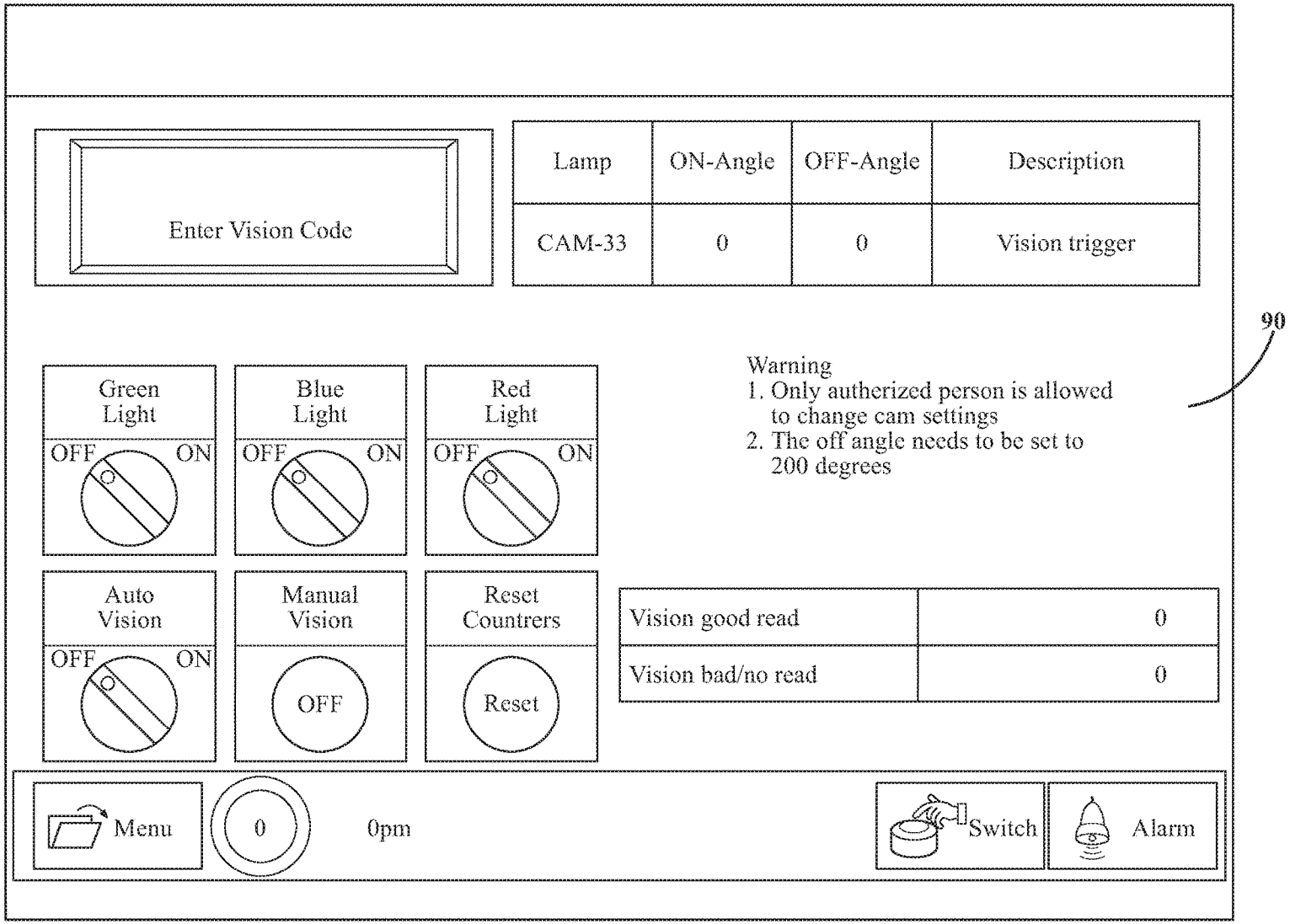
FIG. 5 is a frontal view of a control screen for the inspection module.

The digital camera 37 is connected wirelessly to a remote screen at a control panel or other desired location. Full control of the camera and light is done at the control panel 90 as shown in FIG. 5. The camera allows inspection of the print quality. If the print is blurred or unreadable, or if it is not accurate, for instance, if case lot is not proper, the pouch is rejected and will not be filled.

Figure 4:
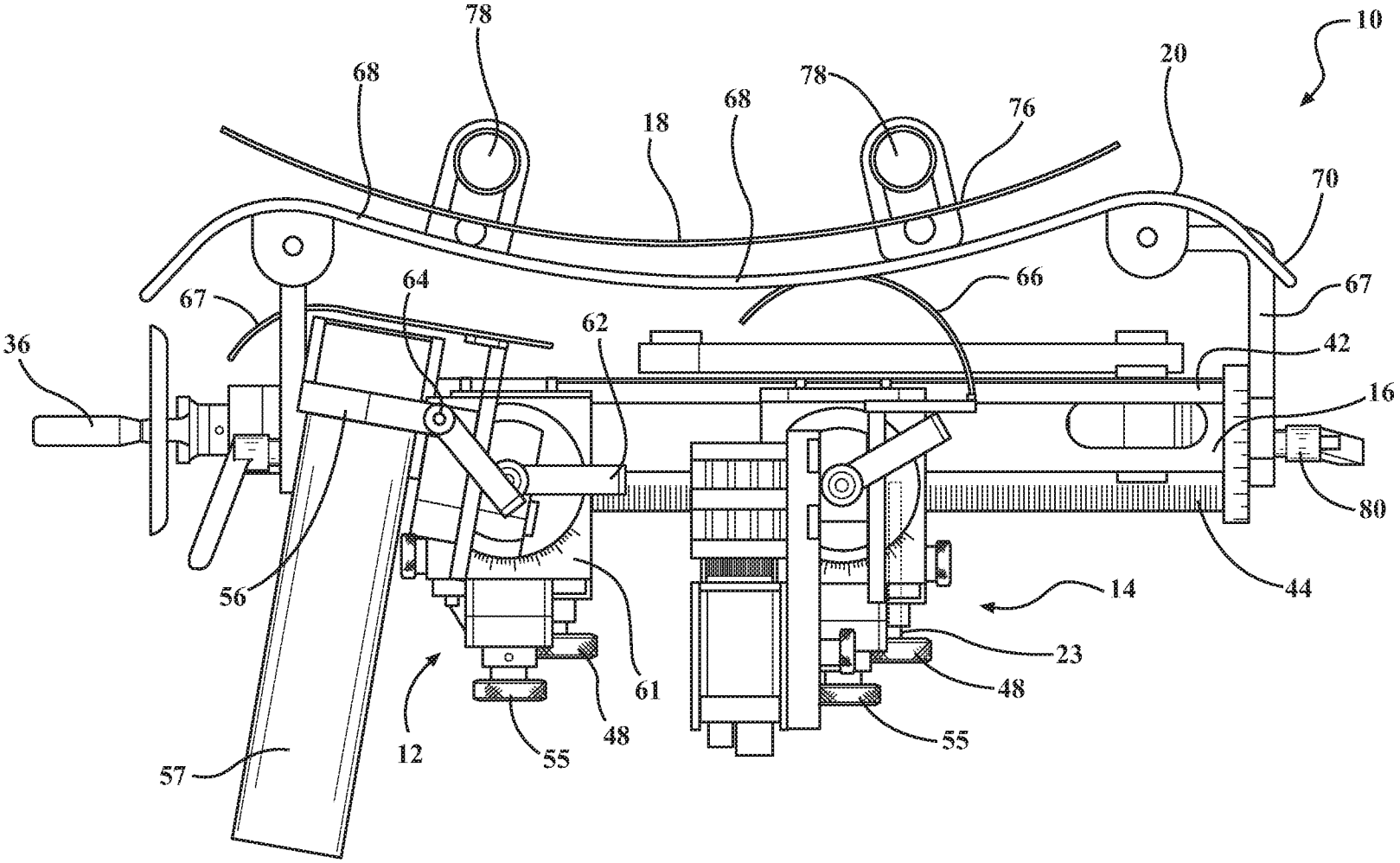
FIG. 4 is a top view of the apparatus for printing and filling without the turret.

As shown in FIG. 4, the wire guide 20 is mounted to the platform by a pair of arms 67. The wire guide has two elongated members, an upper wire 58 and a lower wire 60, which are spaced apart to permit the printer cartridge and camera and a clear line of sight to the pouch 22. The center 68 of the upper wire and lower wire 18 curved to have a slightly larger radius then the path of the pouches 22. The ends 70 of the wires 58 and 68 are curved in the opposite direction to provide an opening to guide the pouch between the wire and back plate 18.

The arms 67 of the wire guide are movable radially inward and outwardly with respect to the platform. Tension handles 80 are used to release the tension to allow the arms to move along slots. Adjustment release may be a Kipp handle which is a cam to release the tension to allow rotation to release or tighten the adjustment point.

As shown in FIG. 3, the back plate 18 is supported by a pair of arms 22 to which extend from the base 30 or from the platform 16. The back plate 18 curves with respect to the center rotation of the turret 24. The back plate 18 extends the full height of pouches which will be filled on the machine.

As shown in FIG. 1, the back plate and wire guide are spaced apart to form a path for the pouches as the turret rotates the pouch between stations. The curved wire of the front guide is adjustable in and out to ensure that the pouch is constantly flat as it is moved by the rotary turret and index from station to station.

Thus, is disclosed an apparatus which includes both a print head module and a camera module. The apparatus permits highest print character readability possible in a repeatable process for a quick change over from one pouch size to another. The assembly includes a back plate which is full height and width and wire guide which matches the radius in the rotary machine so that no adjustment is needed on the back plate guide.

The apparatus includes individual guides for the print head and camera allowing for fine tune adjustment of the print and camera module location by hand wheel with indicators for repeatability and individual adjustment for the print head and the camera.

The invention claimed is:

1. An apparatus for printing and inspecting a pouch, while the pouch is being supported by a turret of a fill machine, the turret moving the pouch from station to station about a center of rotation, the apparatus comprising:

a base;

a platform mounted to the base by a vertical adjustment mechanism to be positioned at a position along a vertical axis;

an inspection module having a camera module for inspecting the pouch and a print module having a print head for printing the pouch;

a guide mounted to the platform to guide the pouch, as the turret moves the pouch to a station for printing; and a curved back wall spaced apart from the guide for forming a path to position the pouch as the pouch is moved by the turret for printing and inspection.

2. The apparatus of claim 1, further comprising at least one pair of scissor arms extending between the base and platform and a screw rod connected to one end of one of the scissor arms of the pair scissor arms to move the pair of scissor arms together and apart to adjust the position of the platform.

3. The apparatus of claim 1 further comprising a horizontal adjustment mechanism for adjusting the position of the print module and camera module along the platform.

4. The apparatus of claim 1 wherein the horizontal adjustment mechanism of claim 3 further including a screw rod and a first threaded member mounted to the print module and a second threaded member mounted to the camera module, the screw rod being received in the first and second threaded members.

5. The apparatus of claim 1, further including a pair of spaced apart elongated members, each of the pair of elongated members having a curved section that extends along an arc centered with the center of rotation of the turret.

6. The apparatus of claim 5, wherein one of the pair of elongated members is positioned above the print module and inspection module and the other of the pair of elongated members is positioned below the print module and camera module.

7. The apparatus of claim 5, wherein the guide is adjustably mounted to the platform to move to and away from the camera module.

8. An apparatus for printing and inspecting a pouch, while the pouch is being supported by a turret of a fill machine, the turret moving the pouch from station to station about a center of rotation, the apparatus comprising:

a base;

a platform mounted to the base by a vertical adjustment mechanism to be positioned at a position along a vertical axis;

an inspection module having a camera module for inspecting the pouch and a print module a print head for printing the pouch;

a guide mounted to the platform to guide the pouch, as the turret moves the pouch to a station for printing; and a pair of spaced apart elongated members each of the spaced apart members having a curved section that extends along an arc centered with the center of rotation of the turret for forming a path to position the pouch as the pouch is moved by the turret for printing and inspection.

9. The apparatus of claim 8, further comprising at least one pair of scissor arms extending between the base and platform and a screw rod connected to one end of one of the scissor arms of the pair scissor arms to move the pair of scissor arms together and apart to adjust the position of the platform.

10. The apparatus of claim 8 further comprising a horizontal adjustment mechanism for adjusting the position of the print module and camera module along the platform.

11. The apparatus of claim 8 wherein the horizontal adjustment mechanism of claim 10 further includes a screw rod and a first threaded member mounted to the print module and a second threaded member mounted to the camera module, the screw rod being received in the first and second threaded members.

12. The apparatus of claim 8, wherein one of the pair of elongated members is positioned above the print module and inspection module and the other of the pair of elongated members is positioned below the print module and camera module.

13. The apparatus of claim 8, wherein the guide is adjustably mounted to the platform to move to and away from the camera module.

* * * * *